US007116054B2

(12) United States Patent
Zhurin

(10) Patent No.: US 7,116,054 B2
(45) Date of Patent: Oct. 3, 2006

(54) HIGH-EFFICIENT ION SOURCE WITH IMPROVED MAGNETIC FIELD

(75) Inventor: Viacheslav V. Zhurin, 548 Charrington Ct., Fort Collins, CO (US) 80525

(73) Assignee: Viacheslav V. Zhurin, Fort Collins, CO (US)

( * ) Notice: Subject to any disclaimer, the term of this patent is extended or adjusted under 35 U.S.C. 154(b) by 14 days.

(21) Appl. No.: 11/111,019

(22) Filed: Apr. 21, 2005

(65) Prior Publication Data

US 2005/0237000 A1 Oct. 27, 2005

Related U.S. Application Data

(60) Provisional application No. 60/565,115, filed on Apr. 23, 2004.

(51) Int. Cl.
*H01J 7/24* (2006.01)

(52) U.S. Cl. ..... 315/111.41; 313/361.1; 250/427

(58) Field of Classification Search ..... 315/111.01–111.81, 500–506; 250/427, 250/423 R; 118/665, 723 I, 723 FI; 313/231.31, 313/359.1, 361.1, 231.71
See application file for complete search history.

(56) References Cited

U.S. PATENT DOCUMENTS

| | | | | |
|---|---|---|---|---|
| 4,862,032 | A | 8/1989 | Kaufman et al. | 118/665 |
| 6,608,431 | B1 | 8/2003 | Kaufman | 313/231.31 |
| 6,645,301 | B1 | 11/2003 | Sainty | 313/359.1 |
| 6,696,792 | B1 * | 2/2004 | Foster | 315/111.41 |
| 6,750,600 | B1 * | 6/2004 | Kaufman et al. | 313/361.1 |
| 6,849,854 | B1 * | 2/2005 | Sainty | 250/423 R |
| 6,919,672 | B1 * | 7/2005 | Madocks | 313/359.1 |

* cited by examiner

*Primary Examiner*—Wilson Lee

(57) ABSTRACT

A Hall-type ion source for generation of ion beams for technological applications presents itself a hybrid ion source, where properties of closed drift systems and end-Hall ion sources are combined for more efficient operation. An ion source has shorter central magnetic pole than regular closed drift ion source with magnetic screens that provide positive magnetic gradient in an ion source's discharge channel. An ion source with these combined properties has higher ratio of ion beam current to discharge current than end-Hall ion source and wider range of discharge parameters than closed drift ion source.

3 Claims, 7 Drawing Sheets

HIGH-EFFICIENT ION SOURCE WITH IMPROVED MAGNETIC FIELD

CROSS-REFERENCE TO RELATED APPLICATION

This application is based upon, and claims the benefit of Provisional Application No. 60/565,115 filed on Apr. 23, 2004.

BACKGROUND OF THE INVENTION

1. Field of the Invention

This invention relates generally to technology of ion and plasma sources, and more particularly to Hall-type ion sources producing high-current ion beams that can be utilized in thin film processing technology. Historically, thrusters, or accelerators of ions were utilized for space application to move, or stabilize space satellites since early 70-ies. Ion sources that can be considered a spin-off of electric propulsion thrusters have the same operational principles. However, they do not need to be light and efficient as thrusters; they need to accelerate ions, produce high ion beam currents with regulated ion beam mean energy, be efficient in vacuum etching, deposition, in assisting to certain physical processes involving interaction of sputtered particles with surface of a substrate. Hall current in ion and plasma sources is a result of interaction of electrical charge carriers—electrons and ions caused by separate direction of electric and magnetic fields. Change of conditions leading to a value of charged particles density by a value and geometry of magnetic field, shape of electrodes and discharge channel leads to separation of charged particles caused by particles different trajectories and appearance of Hall current, which is directed to a normal to vectors of electric field, E and magnetic field, B.

2. Description of the Prior Art

For technological applications, one of Hall-type ion sources was introduced in 1989 in U.S. Pat. No. 4,862,032 by Kaufman, et al., which in 2003 was modified in form of a modular ion source by Kaufman, U.S. Pat. No. 6,608,431 B1. This ion source also considered as gridless ion source with a discharge chamber determined by a conical shape of a hollow anode, and also called an end-Hall ion source with a circular discharge region and only an outside boundary. In 2003 Sainty obtained a U.S. Pat. No. 6,645,301 B2 called "Ion Source". This patent has a very similar concept and design of a Hall ion source as in U.S. Pat. No. 4,862,032 by Kaufman et al., and practically the same conical shape of a hollow anode, with some minor changes such as a gas distributing system (reflector), which in Sainty's patent is at an anode potential. In Kaufman et al., U.S. Pat. No. 4,862,032, and in Kaufman U.S. Pat. No. 6,608,431 B1 a gas distributing system is at floating potential. These publications are incorporated herein by reference.

In general, among gridless ion sources there are two most common types of ion sources, both also called as Hall ion sources: a closed drift ion source with annular discharge chamber and an end-Hall ion source with a circular discharge chamber occupied mostly by a hollow anode of a conical shape. However, for a distinction, the first one will be called a closed-drift ion source and the second one, an end-Hall ion source. Both types of ion sources utilize a Hall effect that playing a major role in acceleration of ions.

Ion sources with closed electron drift have been utilized from early seventies, since appearance in space of first Russian thrusters with closed electron drift in 1972. A detailed review of closed drift ion sources/thrusters features, which is applied to any Hall-current sources, is described by Zhurin, et al., in article "*Physics of Closed Drift Thrusters*" in *Plasma Sources Science & Technology,* Vol. 8 (1999), beginning on page R1. This publication is incorporated herein by reference.

Such ion sources operate in a following way. Working gas supplied into a channel close to anode is ionized by electrons moving under impact of electric field from cathode to anode in a radial magnetic field. In a traditional performance, an ion source comprises of anode, cathode, discharge chamber with accelerating channel, a magnetic system with magnetic poles, magnetic means provided by electromagnetic coils, or permanent magnets, a central core and a magnetic path. A magnetic system is designed in a way that in an annular accelerating channel a mainly radial magnetic field is realized. An electric potential is applied between anode and cathode, and an electric field in a discharge channel is directed approximately parallel to an ion sources axis. A working gas, which must be ionized, is supplied into a discharge channel through anode. Though it is possible, and used frequently, working gas is applied through a separate gas distributor, regularly placed under anode area, and from this area a working gas is directed into an anode area.

In closed drift ion sources, there are two main types of ion sources distinguished with length and material of a discharge channel. One type, called a magnetic layer ion source, which has a discharge channel length that is greater than its width and usually has discharge channel made of dielectric material; though, there are types of a magnetic layer ion source that discharge channel walls made of a conducting material. The other type, called an anode layer ion source has a discharge region length that is less than its width and its walls made of conducting material. Both sources have very similar characteristic performance with some non-fundamental differences.

In Hall ion sources a magnetic field value is selected in such a way that Larmour radii for electrons, $r_{Le}$ and ions, $r_{Li}$ calculated through energy corresponding to applied potential difference satisfy to a condition: $r_{Le} \ll L \ll r_{Li}$, where L is a characteristic dimension of an acceleration region in an ion source's discharge channel. In Hall ion sources a cyclotron frequency of electrons, $\omega_e$ must be greater than a frequency of electron collisions, $\nu$ with other particles and discharge channel walls, i.e. $\omega_e \gg \nu = 1/\tau_e$, where $\tau_e$ is an average time between electron collisions with other particles and discharge channel walls. That is why so-called Hall parameter, $\omega_e\tau_e$ that utilized for a characterization of electron magnetization is $\omega_e\tau_e \gg 1$.

The condition for magnetization of electron component in plasma ($\omega_e\tau_e \gg 1$) and, at the same time, an ion component is not magnetized ($\omega_i\tau_I \ll 1$) means that a determining process in closed drift ion sources is an ion current motion in a discharge region, and an electric field is "suspended" on a magnetized electron component. In end-Hall ion and some other types of ion sources, electrons in certain areas of discharge channel occupied by plasma (at exit in end-Hall ion sources) can be only partially magnetized. In such cases, Hall effect leads to a change of direction of electron motion and to a corresponding change of volumetric forces forming and accelerating plasma flow. Hall parameter, $\beta_e$ determines a relative value of a Hall electromotive force and influence of a magnetic field on plasma electric conductivity, $\sigma$: $\beta_e = E_{Hall}/E == |j \times B|/[(1/\sigma)|j|en] = \sigma B/en = \omega_e\tau_e$. With the increase of a Hall parameter, $\omega_e\tau_e$ a motion of charged particles across of a magnetic field becomes more difficult and particles begin to drift with a velocity, $\nu = (E \times B)/B^2$, or in mutually orthogonal fields, E and B. A drift velocity can be determined through a ratio of electric and magnetic fields, $v_{drift}=E/B$.

In closed-drift and in certain area of end-Hall ion sources a primary motion of electrons is in azimuthal direction. Because an azimuthal electron velocity is significantly higher than a longitudinal electron velocity component, electron trajectories are almost closed. And this determines a name of a first one: a source (or a thruster) with a closed electron drift.

End-Hall ion sources also can be called sources with closed electron drift, however, a situation here is different. A Larmour electron radius, $r_{Le}$ is smaller than L, but only at a gas distributor/reflector, where a magnetic field usually is quite strong. In existing end-Hall ion sources this value is from 600 to 1000 G. And a magnetic field in this area has mainly an axial direction. Magnetic field decreases significantly from a gas distributing area and at the discharge channel's exit it is only about 50–60 G. In general, in existing closed-drift ion sources, a magnetic circuit is designed in such a way that a magnetic field increases from anode to a discharge channel's exit. The best efficient operating closed drift ion sources have a magnetic maximum optimum value of about 200–450 G for Argon and 450–750 G for xenon. In end-Hall ion sources the applied magnetic field lines are mainly axial at the top of gas distributing system-reflector and are mainly radial at exit of discharge channel, close to an external magnetic pole. The end-Hall ion sources have a negative magnetic gradient and the closed-drift ion sources have a positive magnetic gradient in a discharge channel.

In a process of ion sources operation, a motion of electrons takes place from cathode to anode region and to anode itself, this motion is accompanied by collisions with atoms of working material, with ions, with discharge chamber walls and due to discharge oscillations. As it was above noted, ions are practically not magnetized and they move mainly along applied electric field and are accelerated in this field. A flow of ions "captures" necessary number of electrons produced by an external source of electrons, so these ions become neutralized and together they develop a plasma flow.

Since electrons drifting in an azimuthal direction neutralize an ion volumetric charge in an ion source's discharge channel, in closed drift and end-Hall ion sources there is no limit for an ion beam current by a space electric charge. This feature is a significant advantage of closed-drift and end-Hall ion sources in comparison with electrostatic or so-called gridded ion sources.

Because electrons in magnetic field are moving along magnetic field lines relatively free before their collisions with neutral atoms, in a first approximation it is possible to consider the surfaces going through magnetic field lines in an azimuthal direction as surfaces of equal potential. This is one of major ideas in a possibility and necessity to control and focus an ion flow through a selection of a corresponding configuration of magnetic field lines.

In both types of ion sources, end-Halls and closed-drift types it is necessary to have a source of electrons to start a discharge and ionization of a working gas. Analysis of discharge at low pressure (rarefied regimes, $P \leqq 1$ mtorr) and moderate discharge voltages (50–1000 V) and currents (1–20 A) shows that from about 50 to 350 V a discharge represents itself so-called a non-self-sustained discharge and from about 350 V and higher it represents a self-sustained discharge. It means that, in order to maintain a discharge in a discharge channel of these ion sources, it is necessary to provide a source of electrons at discharge voltages under about 350 V. For ion sources with operating discharge voltages over 350 V it is necessary to start discharge and after its beginning it can maintain itself providing electrons from small sparks in vacuum chamber and ion source's discharge chamber itself.

Hot filaments and hollow cathode electron sources are generally used as cathodes in closed drift and end-Hall ion sources. Hot filaments, which utilize a tantalum and tungsten wire, can produce electron currents from about 0.1 A to about 30 A. Modern hollow cathode-neutralizers make possible to obtain electron currents from 0.5 A to 75–100 A with a flow of working material that in 10–50 times lower than in an ion source itself. However, there are other types of cathodes that can be utilized for neutralization of Hall-current ion source's ion beam, such as a "plasma bridge" and a "cold hollow cathode", a device utilizing a glow discharge in a longitudinal magnetic field.

One of the most distinguished features of a U.S. Pat. No. 4,862,032 by Kaufman, et al., as it was above mentioned, is that a magnetic field strength decreases in a direction from anode to cathode: page 2, lines 55–59; page 10, claim 1, lines 60–64; page 11, claim 4, lines 55–59. This provision is very distinct and emphasized through the whole patent and makes it, as was above mentioned, an ion source with a negative gradient of magnetic field. And this particular feature, a decreased value of a magnetic field along an ion source's discharge region, substantially reduces a range of operation conditions of an end-Hall ion source, especially in the range of discharge voltages over 300 V, and can be considered as a major shortcoming of that type of ion source.

There are other important shortcomings of existing end-Hall ion sources caused by a negative magnetic gradient of magnetic field in a discharge channel of such an ion source. These are the following shortcomings that necessary to mention:

a) An ion beam current, $I_b$ is only about 20–25% of a discharge current, $I_d$ or $I_b/I_d \approx 0.2$–$0.25$, because the conditions for efficient ionization of atomic particles in a discharge chamber do not exist;

b) Ratio of equivalent mass flow current, $I_m$ ($I_m=em_a/M$, where e is electron charge, $m_a$ is working gas mass flow, and M is working gas atomic mass) of consumed mass flow to an ion beam current, $I_m/I_b \geqq 1.2$, which means that at low discharge currents ($I_d<5$ A) and high mass flows, the most portions of working gas is not utilized efficiently. However, at higher discharge currents ($I_d>5$ A)$I_m/I_b \leqq 1.2$, meaning that a certain portions of working gas is double ionized particles. For good efficient operation of ion source an ion beam current and equivalent mass flow current must be close to each other, or $I_m/I_b \approx 1$.

b) A gas-distributor, called sometime as a reflector, which is usually under a floating potential (it assumes plasma potential of a discharge channel), as in U.S. Pat. No. 4,862,032 by Kaufman et al., or at anode potential, as in U.S. Pat. No. 6,645,301 B2 by Sainty, has very short time. Its central part is bombarded by energetic ions that are a part of a whole anode flow that, in general, is moving outside of a discharge chamber but some substantial parts are moving in opposite direction, to a gas distributor. In result, in a central part of a gas-distributor/reflector after about 10–20 hours of operation at discharge currents, $I_d \geqq 5$ A, and $V_d \approx 150$ V, there can be observed either a hole, or a big chunk of material is removed by sputtering from a central part of a gas-distributor, depending on discharge parameters. This shortcoming feature is not only forces to frequently substitute gas-distributors, but their sputtering contaminates process's targets and substrates by a gas-distributor's material, because after an ion bombardment sputtered particles move out of discharge chamber and become deposited all over a vacuum chamber and other parts.

c) Existing end-Hall ion sources have problems in operation at discharge voltages over 300 V. High amplitudes of discharge current and oscillations are developed and prevent normal discharge process making a range of operation insufficient for certain necessary conditions in many cases in technology: discharge currents should be over 10 A and discharge voltages should be 1000–1500 V. Such operation conditions, with high discharge currents and voltages significantly enhance sputtering and deposition. The developed oscillations are explained by a configuration of a magnetic field that decreases from anode to cathode, or a negative gradient of a radial magnetic field.

d) An ion beam coming out of end-Hall ion source is very divergent: due to a decreasing magnetic field, and due to a design of an end-Hall ion source that has an external magnetic pole piece placed quite wide following an anode's conical shape.

Thin film deposition in many cases requires ion assisting of low energy ion sources. Magnetic field configuration with strong axial component of magnetic field makes possible for end-Hall type ion sources to operate at discharge voltages, $V_d$ lower than 100 V, at 40–50 V with Argon and at 20–30 V with Xenon. Closed drift ion sources with strong radial component of magnetic field at ion source's exit make possible to start discharge at voltages from 100 V to over 1000 V with practically all working gases. A combination of both types of ion sources helps to extend a range of operating conditions.

A B-E (magnetic-electric fields) discharge should effectively combine several functions: to prevent direct motion of electrons from cathode to anode, forcing electrons to drift to anode in closed loops, to generate and accelerate ions in a discharge channel. In general, a B-E discharge always has oscillations and instabilities of main operating parameters: discharge current, $I_d$ and voltage, $V_d$. Oscillations and instabilities were found by researchers from the beginning of studying closed-drift and end-Hall ion sources and thrusters. However, most instabilities and oscillations actually is a part of normal operation of ion sources. And, a presence of oscillations in plasma with intensity that does not exceed certain critical value, even if they lead to a partial decrease of efficiency of ion production, can provide stable operation of ion source in regimes that could not be realized otherwise. However, instabilities and oscillations that become about 100% of discharge current, $I_d$ and voltage, $V_d$ can destroy normal discharge and extinguish ion source operation.

In general, there are many different types of oscillations accompanying B-E discharge. Among them there are several groups of the most prominent and important oscillations that can disrupt normal operation of an ion source. More detailed information about oscillations in B-E discharge can be found in a mentioned article by Zhurin, et al., "*Physics of Closed Drift Thrusters*" in *Plasma Sources Science & Technology,* Vol. 8 (1999), beginning on Page R1. These oscillations are:

Contour oscillations are longitudinal oscillations with a characteristic frequency of 1–30 kHz. Their mechanism is due to instability of ionization region in a discharge area. These oscillations are most intense oscillations and at the regimes with developed oscillations of this type there are observed a 100% modulations of discharge parameters. Contour oscillations can be suppressed by a correct configuration of a magnetic field, discharge voltage, working mass flow, and parameters of power supply.

Ionization oscillations have maximum frequencies in a range of tens to hundreds of kHz. These oscillations are caused by an azimuthal wave traveling in a direction of electron drift; they are connected with an ionization wave of a working material. This instability appears beginning from a certain critical value of a parameter $I_dB/m_a$ (where $I_d$ is a discharge current, B is a magnetic field, and $m_a$ is a working material mass flow); with a growth of this parameter an amplitude of a discharge voltage increases achieving 15–25% of a nominal discharge voltage. Ionization instability can be decreased substantially with a higher discharge current, when a regime of complete ionization is observed.

Flight oscillations are characterized by a broad spectrum of frequencies in a range of 100 kHz up to 10 MHz and they correspond to an ion flight time through a discharge channel. Amplitude of flight oscillations can achieve 20–30% of value of discharge parameters. Plasma potential and particles density are pulsed along an ion source synchronously; however, these oscillations are non-symmetrical along azimuth, and this leads to development of alternating electric fields. Plasma turbulence increases with appearance of flight oscillations.

Spoke-type oscillations. Every type of ion source always has a certain range of optimum operation parameters such as discharge current, $I_d$ and voltage, $V_d$, working material (gas) mass flow, $m_a$, magnetic field, B. Before an ion source starts operation in optimum regime, at a low-voltage part of volt-ampere characteristics of discharge there always takes place an ionization instability of a spoke type that rotates in an azimuthal direction with a constant velocity, $v_\varphi \approx c_v E_z/B_r$, where $c_v$ is a constant in a range of 0.4–0.8. A structure of this oscillation wave (20–60 kHz) is characterized by an increased electron concentration, $n_e$.

High-frequency oscillations are typically in a range of 1–100 MHz. They are hybrid azimuthal oscillations developed in an ion source with a negative gradient of a magnetic field. These oscillations are harmful for end-Hall type ion source in a whole discharge channel and in closed drift ion sources they are important at an ion source's exit, where magnetic field changes from positive to negative gradient.

The most intensive are contour oscillations. These oscillations are also a problem for end-Hall type ion sources, where a magnetic field decreases in a discharge region. Such oscillations lead to a substantial divergence of ion flow, to sputtering of a discharge channel, to unnecessary discharge channel's heating.

Due to great importance for solution of oscillation problem for optimization of processes in closed drift and Hall-type ion sources, it is necessary to use different ways for stabilization and suppression of instabilities. Besides of above mentioned article by Zhurin, et al., "*Physics of Closed Drift Thrusters*" in *Plasma Sources Science & Technology, Vol.* 8, beginning on page R1, there are many other studies devoted to oscillation problem in ion and plasma ion sources/thrusters such as Zhurin, et al., "*Dynamic Characteristics of Closed Drift Thrusters*", published at 23rd International Electric Propulsion Conference, Sep. 13–16, 1993, IEPC-93-095, beginning on page 1, and Randolph, et al., "*The Mitigation of Discharge Oscillations in the Stationary Plasma Thruster*", published at 30th AIAA Joint Propulsion Conference, Jun. 27–29, 1994, beginning on page 1. These publications are also incorporated herein by reference.

A fundamental criterion for suppression of instabilities in Hall-current closed drift ion sources/thrusters was introduced by Morozov in article "*On Equilibrium and Stability of Flows in Accelerators with Closed Electron Drift*" in Russian publication "*Plasma Accelerators*", Proceeding of 1st All-Union Conference on Plasma Accelerators, Moscow, Publishing House "Mashinostroenie", 1973, beginning on page 85, that in Hall-current ion sources/thrusters with closed electron drift, in order to have a flow with suppressed oscillations, it is necessary to utilize in a discharge channel a magnetic field with a positive magnetic gradient: $\partial B_r/\partial x>0$. Morozov's publication is incorporated herein by reference. In above mentioned article by Zhurin, et al., in an article "*Physics of Closed Drift Thrusters*" in *Plasma Sources & Technology, Vol.* 8, on page R8 there is information about this stability criterion.

SUMMARY OF THE INVENTION

In light of foregoing, it is an object of the invention to introduce an ion source of a Hall-current type with improved positive magnetic field gradient. Such magnetic field configuration in a cylindrical and cone shape discharge channel makes possible to suppress oscillations and instabilities.

Another object of the present invention is to provide an ion source with a high efficiency of ionization in a discharge channel. Such efficient ionization leads to a conversion of a discharge current to about 90% of particles into an ion beam current. In other words, in contrast with existing end-Hall ion sources with a conversion of only about 20–25% of a discharge current into an ion beam current, the invented ion source provides about 90% of a discharge current into an ion beam current.

Still another object of the present invention is to expand operating conditions of the invented ion source for discharge voltages from about 20 V to over 1000 V, and for discharge currents from about 1 A to over 20 A, so a total power applied to the invented ion source can be about 1.5–2 kW without a water cooled anode, and substantially and over 10 kW with a water cooled anode.

Yet a further object of the present invention is to make an ion source with wider range of operation parameters at different magnetic field distributions. This flexibility is provided by following means: a) a placement of magnets in area around a discharge region; b) a placement of a magnetic shunts around an anode area, so that magnetic field lines will go around this magnetic shunt and will develop a positive magnetic gradient in a discharge region, and an anode will be in area with minimum of magnetic field; c) by a gas feed area under anode, this gas volume is a subject of electrons penetration into area under anode and a photo-ionization radiation from a region of ionization and acceleration located downstream from anode area; this gas volume provides a working gas into a discharge area with more higher and uniform initial ionization; d) working gas supplied into a gas volume goes through a series of small holes placed on a periphery of an external magnetic screen with holes having inclination so, that working gas is introduced through a tangential entrance with development of a vortex flow that provides uniform distribution of working gas into gas volume under anode and into anode area.

A further object of the present invention is to provide potential distribution conditions that help to have acceleration of ions mainly in a discharge chamber exit close to a maximum of magnetic field distribution. Such a potential distribution helps to reduce significantly a damage to a gas-distributor/reflector and to make this part of an ion source with longer operating lifetime. An ion beam focusing by a separation of ionization and ion acceleration makes possible to substantially reduce a discharge channel sputtering and a thermal contact of high energy particles and discharge channel walls.

BRIEF DESCRIPTION OF THE DRAWINGS

Features of the present invention, which believed to be patentable are set forth with particularity in the appended claims. The organization and operation manner of the invention, together with further objectives and advantages thereof, may be understood by reference to the following descriptions of specific embodiments taken in connection with accompanying drawings, in the several figures of which like reference numerals identify similar elements and in which:

DESCRIPTION OF PRIOR ART

Figure 1:
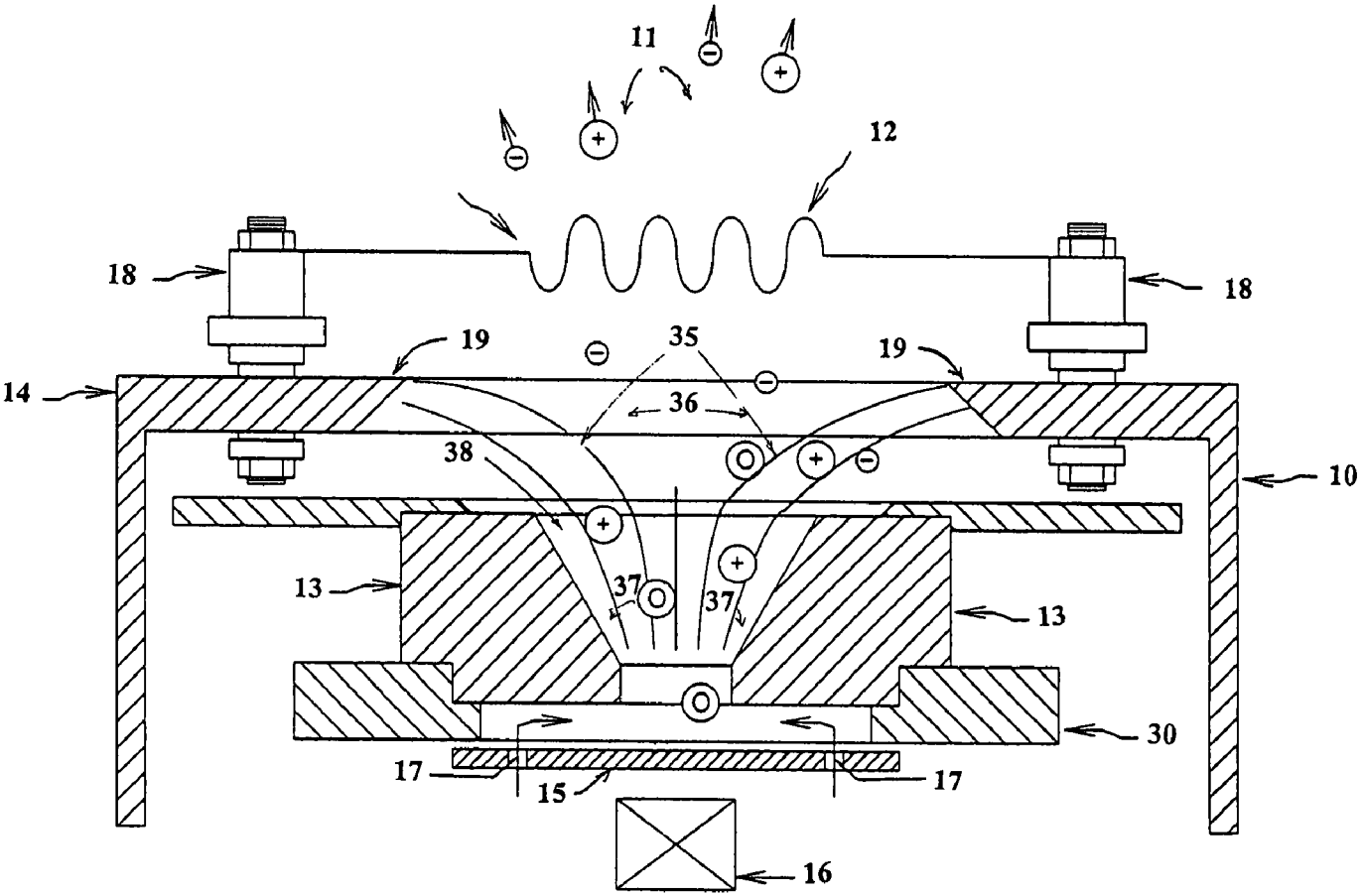
FIG. 1 (PRIOR ART)
FIG. 1 is a schematic drawing of a prior art apparatus of end-Hall ion source described by Kaufman, et al. in U.S. Pat. No. 4,862,032.

Referring to FIG. 1, there is shown a schematic representation of a prior art apparatus, U.S. Pat. No. 4,862,032 by Kaufman et al. With an ion source apparatus 10, a vacuum enclosure surrounds an evacuated volume (not shown) that is maintained at low pressure. Such pressure is usually, at rarefied gas conditions, meaning that a mean free path, l of atoms and ions is much longer than any characteristic dimension, L of a discharge channel length or width, l>>L, pumped through a vacuum enclosure port (not shown). In this Hall-current ion source the magnetic field lines 35 are mostly axial at a gas distributing system and mostly are radial at an ion source exit and an external magnetic pole 19. An ion source 10 generates an ion beam 11 within an evacuated volume.

An end-Hall ion source shown in FIG. 1 comprises of a cathode 12, an anode 13, a magnetic system 14 (shown only an upper part of an ion source magnetic system). A magnetic system 14 usually consists of a magnetic path with a pole 19, a magnet 16, that can be an electromagnet, or a permanent magnet. Magnetic field from magnet 16 decreases from a gas distributor/reflector 15 to a discharge channel exit 36, producing, in general, in a discharge channel 37-36 a magnetic field distribution with a negative gradient of magnetic field, inside a hollow anode 13, at anode's exit 38 and a magnetic pole 19.

Anode 13 made of a non-magnetic material but of good electric conductivity; it has a hollow conical shape and connected through a conducting plate 30 with an anode power supply (not shown); at an anode's exit, its area is substantially wider than at place where a working gas is applied.

Working gases such as Argon and other noble or reactive gases are applied to anode area 37 through a gas distributor/reflector 15 with holes 17.

Hot filament (usually a Tungsten or Tantalum wire) cathode 12 is placed between two cathode supports 18 and electrically isolated from an outer pole piece 19. Cathode supports 18 are connected by a solid insulated wiring (not shown here) through an ion source body 10 to a cathode power supply (not shown). Also, a cathode wiring can be placed outside a main body of an ion source. In many cases, instead of a hot filament there is utilized a hollow cathode, which in design is not so simple as a hot filament, but can provide higher emission currents and much longer lifetime. For end-Hall ion source, hot filament cathodes of 0.020 mil thickness at discharge currents, $I_d$ of about 5 A and discharge voltage, $V_d$ of 150 V (typical operation parameters) can serve from 4 to 6 hours with Argon from 6 to 8 hours with Oxygen, and from 8 to 14 hours with Nitrogen as working gases.

A hollow cathode with the same anode discharge parameters ($I_d$=5 A, $V_d$=150 V) usually operates on noble gases such as Argon (in technology), Xenon (in space, for thrusters) and can serve over 100 hours with Argon utilized in anode and hollow cathode. However, when a hollow cathode (on Argon) utilized with reactive gases such as Oxygen in anode area, its lifetime becomes shorter due to penetration of reactive gases into a hollow cathode area that becomes "poisoned" (oxidized) with reactive gases. Reactive gases sharply reduce emissive ability of a hollow cathode, usually made of Tantalum foil or other emissive materials. Lifetime of hollow cathodes working with reactive gases is usually a half of lifetime of work with noble gases.

An ion beam is developed in area between an anode 13 and cathode 12. Electrons (shown as circles with a sign −) supplied by a cathode are used for ionization of a working gas neutral particles (shown as circles with a sign o) and for neutralization of appeared ions (shown as circles with sign +). In result, neutralized plasma flow 11 exits from an ion source. A negative aspect of this Hall-current ion source is existence of strong plasma flow not only in an ion source exit direction, but also into opposite direction, into a gas distributor/reflector, 15. Such strong plasma flow leads into a severe damage of a gas distributor/reflector, 15 reducing its lifetime significantly. Besides a gas distributor/reflector damage, its sputtered particles fly back into a discharge channel's exit, into a vacuum chamber area leading into contamination of an etching/deposition process involving ion source.

Figure 2:
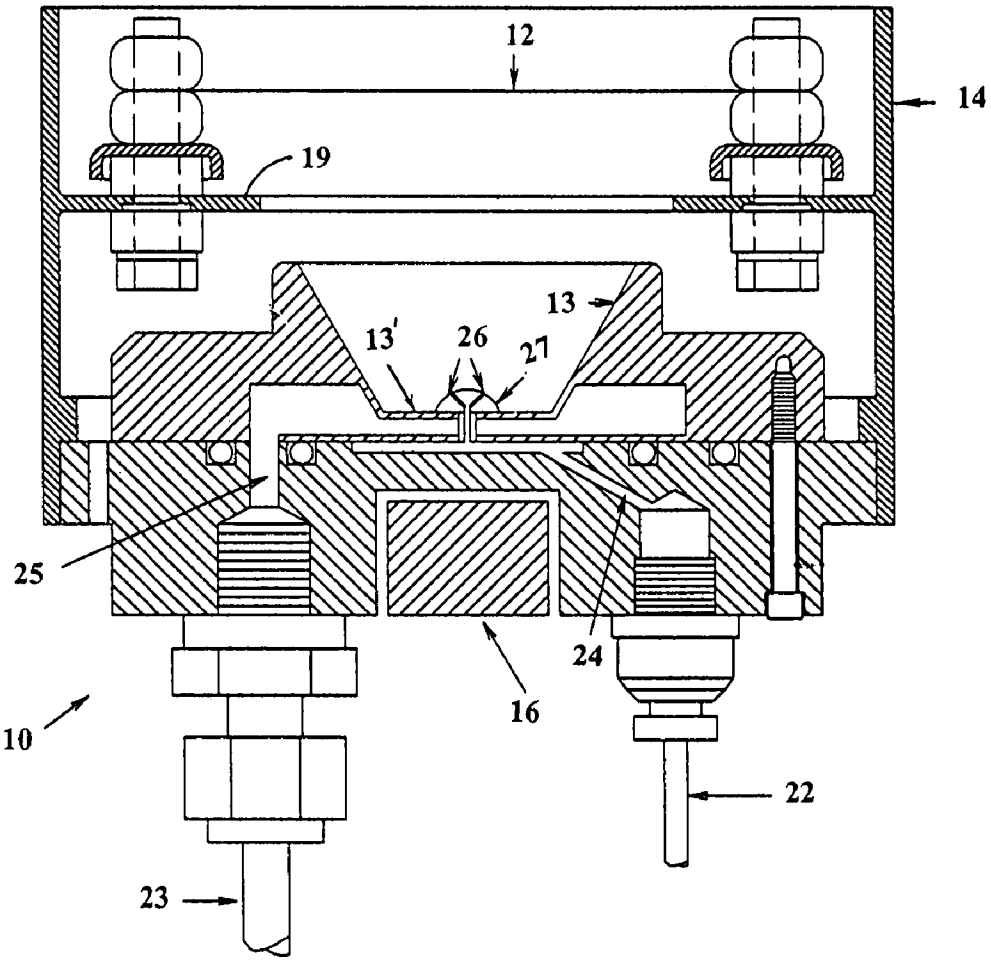
FIG. 2 (PRIOR ART)
FIG. 2 is a schematic drawing of a prior art apparatus of end-Hall ion source described by Sainty in U.S. Pat. No. 6,645,301 B2.

Referring to FIG. 2, there is shown a schematic presentation of an end-Hall ion source, U.S. Pat. No. 6,645,301 B2 by Sainty. This apparatus in general is very similar to a Kaufman et al. design described in U.S. Pat. No. 4,862,032. It differs from a Kaufman et al., design in few details and is shown with a water-cooling system 23 and 25. Magnetic field generated in this ion source is also decreasing its strength from a gas distributing system 27 placed downstream, at conical anode 13.

Working gas is applied through a system 22, 24 and through a gas distributor 27 that has a semi-spherical shape with holes 26 for a working gas and is placed at anode basis 13' with an anode potential.

Magnet 16 develops magnetic field that decreases its strength in a direction to an ion source's exit and produces a negative gradient magnetic field in a discharge chamber. A magnetic field maximum value is at an anode bottom part where a gas distributor 27 is located.

Figure 3:
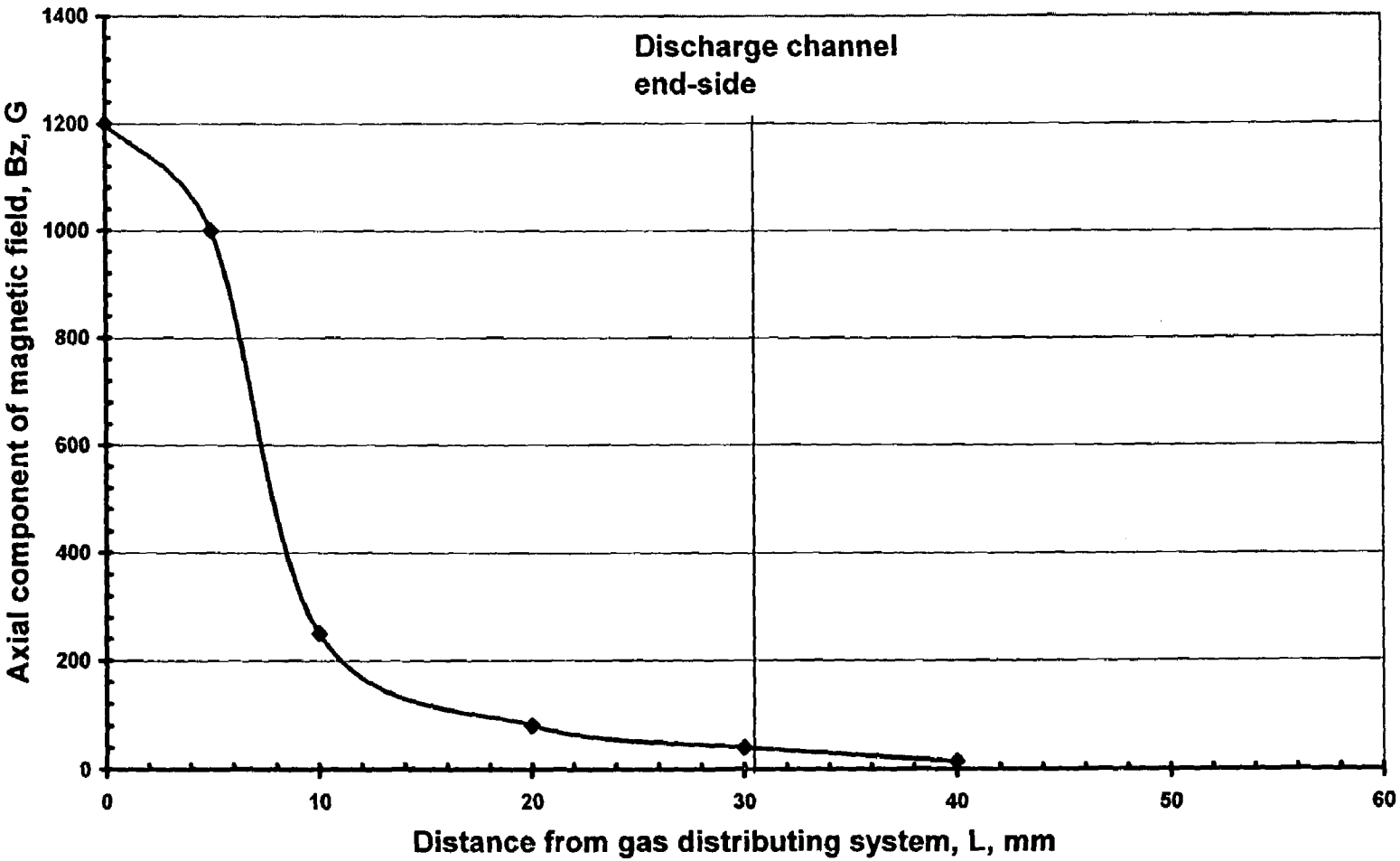
FIG. 3 (PRIOR ART)
FIG. 3 shows an axial component of magnetic field distribution, $B_z$ as a function of distance from gas distributing system, L in a typical end-Hall ion source.

Referring to FIG. 3, one can see a typical geometry of a magnetic $B_z$ distribution along a discharge chamber axis in end-Hall type ion sources. A maximum magnetic field value at a gas distributor could vary typically from about 1000–1500 Gauss to several hundred Gauss decreasing rapidly to an ion source's exit to several tens of Gauss. Utilized magnetic field strongly depends on selected operation conditions such as discharge voltage, $V_d$ and current, $I_d$, sort of working gas (Ar, Xe or reactive gases such as $O_2$, $N_2$ and others).

DESCRIPTION OF THE PREFERRED EMBODIMENTS

Figure 4:
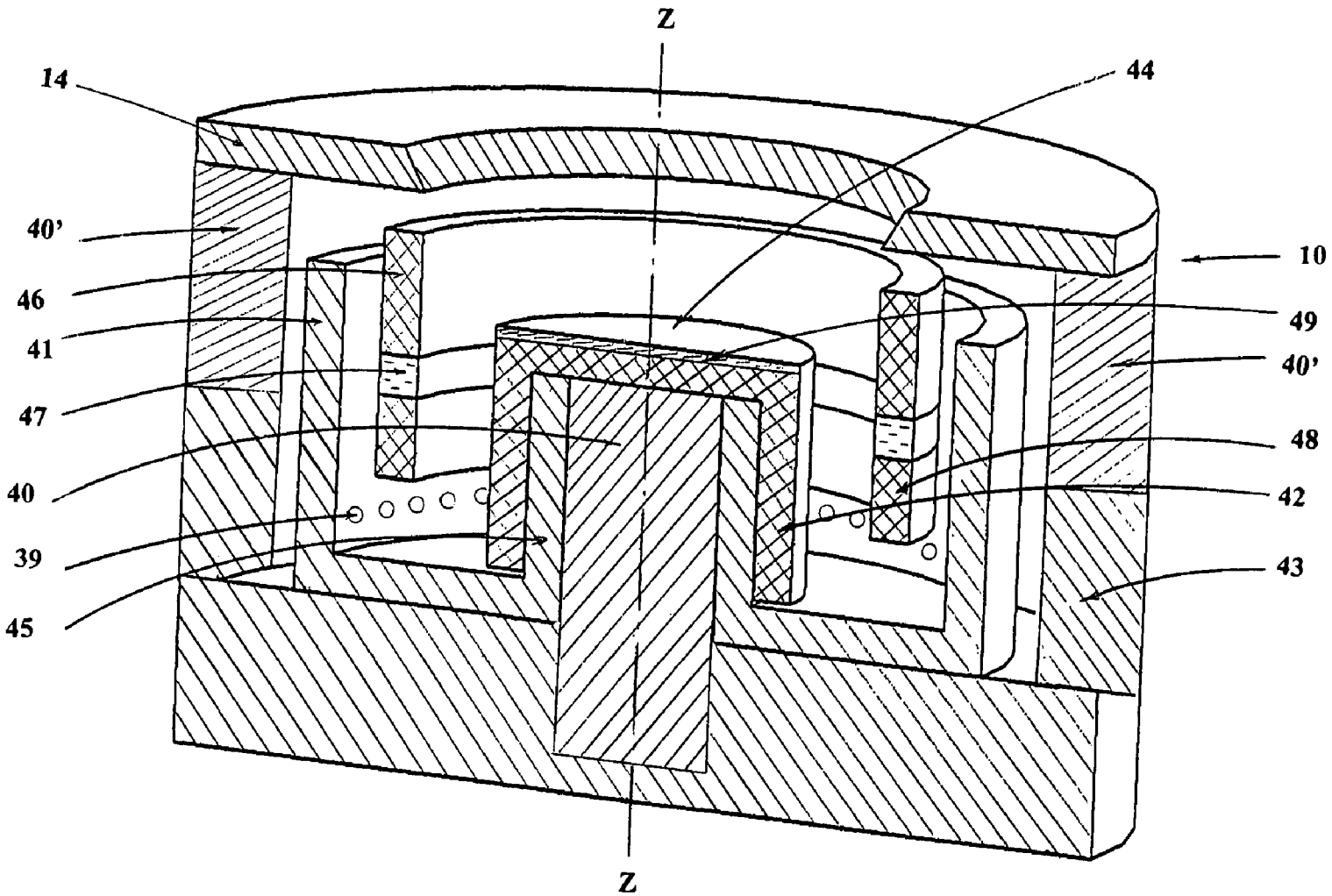
FIG. 4 is a schematic drawing of invented Hall-type ion source with a circular discharge region and only outside boundary, with a positive gradient of magnetic field in a discharge channel and with dielectric walls of a discharge chamber.

FIG. 4 presents a schematic drawing of the invented Hall-current ion source 10 with a hybrid discharge channel consisting of a protruding central magnetic pole 44 and an external cylindrical wall 46, 47, 48. Axis of symmetry is a line Z-Z. An internal cylindrical discharge channel wall, 42 made of dielectric material. The cylindrical external wall parts 46, 48 can be made either from a dielectric material typically out of Boron Nitride, as all existing closed drift thrusters with magnetic layer, or out of a conducting material typically out of stainless steel or copper. A discharge channel with external cylindrical wall made of ceramic material has anode 37 placed at bottom part of discharge channel at certain distance from a gas distributing system 39 (shown holes for working gas application).

A discharge channel with external cylindrical wall made of a conducting material consists of three parts: upper part 46, anode 37, and bottom part 48. Parts 46 and 48 are under a floating potential. It means that an anode 47 is separated from conductive walls 46, 48 either by a dielectric material, or by a gap that prevents from high voltage potential to be applied to parts 46 and 48.

A permanent magnet or a magnetic coil 40 is placed in the central part of ion source's discharge channel and serves as a pole piece 44. A central pole piece 44 is isolated from discharge chamber by a dielectric material 42, and its top is protected by a graphite piece 49 for operation with noble gases such as Argon, or by a stainless steel piece 49 for operation with reactive gases such as Oxygen.

Magnetic screens 41 and 45 are placed outside a central magnet and serve for producing a positive magnetic gradient in a discharge channel.

A magnet placement in a protrusion is similar to regular closed drift ion sources, but this protrusion is extended not for a whole discharge channel length. Such a magnet placement can be called a hybrid placement of central magnetic pole, which is in about a middle of a discharge channel length. In closed drift ion sources a central magnetic pole is extended from gas distributing system a way up to an ion source end-side.

In alternate way, four magnets, 40' are placed outside of a discharge channel as a continuation of a magnetic path, 43. A central magnet, 40 also can be utilized, because with all five magnets it is easy to regulate magnetic field in a discharge channel. In another approach of this invention, four magnets are utilized on external upper part of a magnetic path and a central protrusion made of magnetically soft material that serves as an internal pole. In this case, magnets are outside of a discharge channel and are less influenced by hot plasma of a discharge channel.

Figure 5:
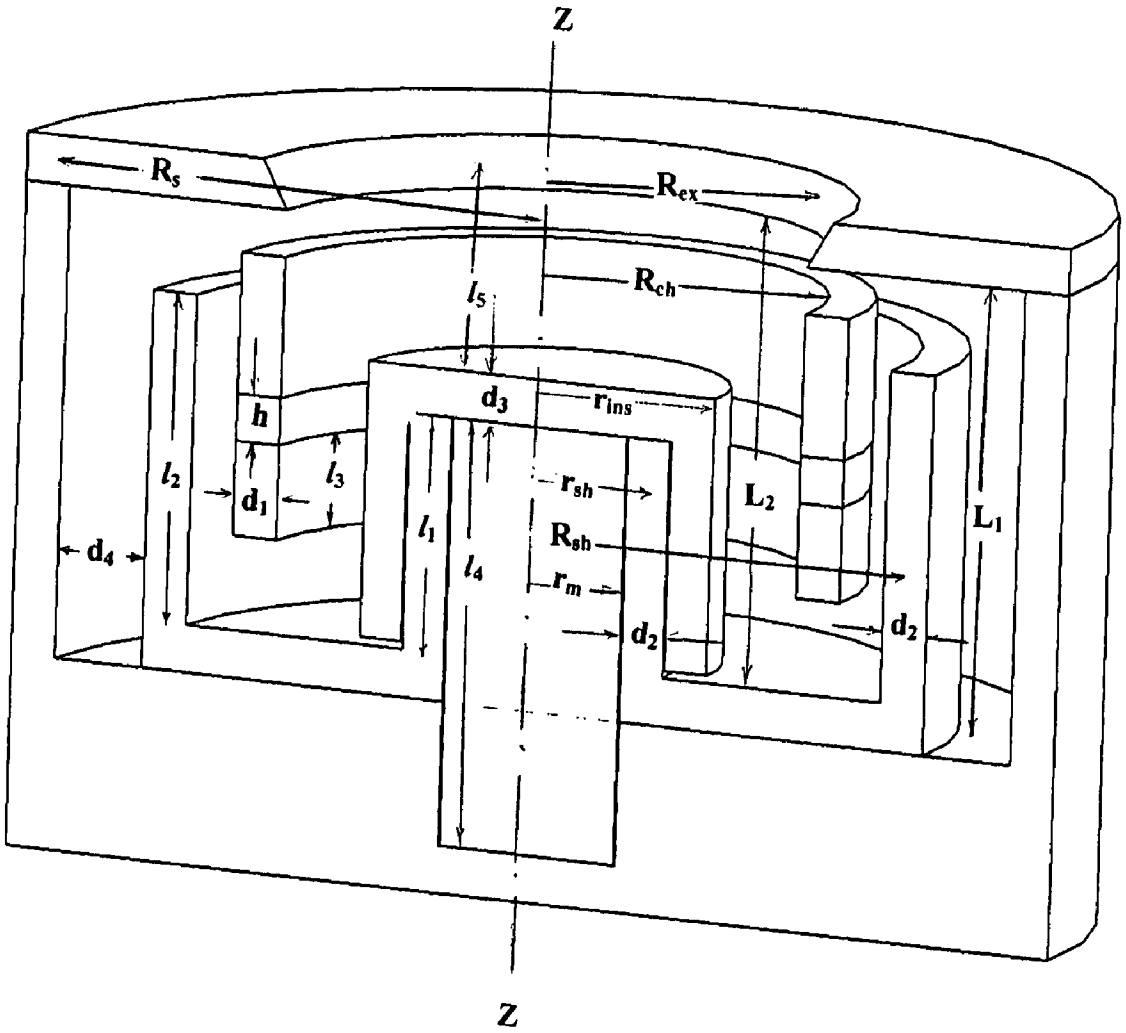
FIG. 5 is a schematic drawing of invented Hall-type ion source with indicated certain important dimensions of this ion source.

FIG. 5 presents a schematic drawing of invented ion source with ion source major parts. These parts are:

Value $R_s$ is a radius of ion source from axis to external magnetic path;

Value $R_{ex}$ is a radius of discharge channel exit;

Value $R_{ch}$ is a radius of discharge channel, which is usually is less than $R_{ex}$;

Value $d_1$ is a discharge channel thickness;

Value $R_{sh}$ is a radius of ion source's external magnetic screen;

Value $r_{sh}$ is a radius of internal magnetic pole;

Value $r_{ins}$ is a radius of insulator separating internal magnetic pole and discharge chamber internal wall;

Value $L_1$ is an ion source length from a magnetic screen base to an external magnetic pole;

Value $L_2$ is a discharge channel length;

Value $l_1$ is an internal magnetic screen length;

Value $l_2$ is an external magnetic screen length;

Value $l_3$ is a distance between anode and a source's base of a gas distributing system;

Value $l_4$ is a central magnet's length; this distance is variable and, in case of utilizing a magnetically soft material as a central magnetic pole, can be a distance of a permanent magnet from a central dielectric surrounding a central magnetic pole;

Value $l_5$ is a distance between magnetic poles;

Value h is anode thickness;

Value $d_2$ is a magnetic shunt thickness;

Value $d_3$ is a dielectric material thickness serving for protection of a central magnetic pole;

Value $d_4$ is a distance between ion source external magnetic path and an external magnetic screen.

A variation of ratio of magnetic screens lengths, $l_1$ and $l_2$ and also a value of a distance between both magnetic poles, $l_5$, or a height of an internal magnetic pole length, $l_3$ and a placement of central magnet, $l_4$ helps to establish necessary magnetic field distributions with a positive magnetic field gradient and a magnetic field strength.

Figure 6:
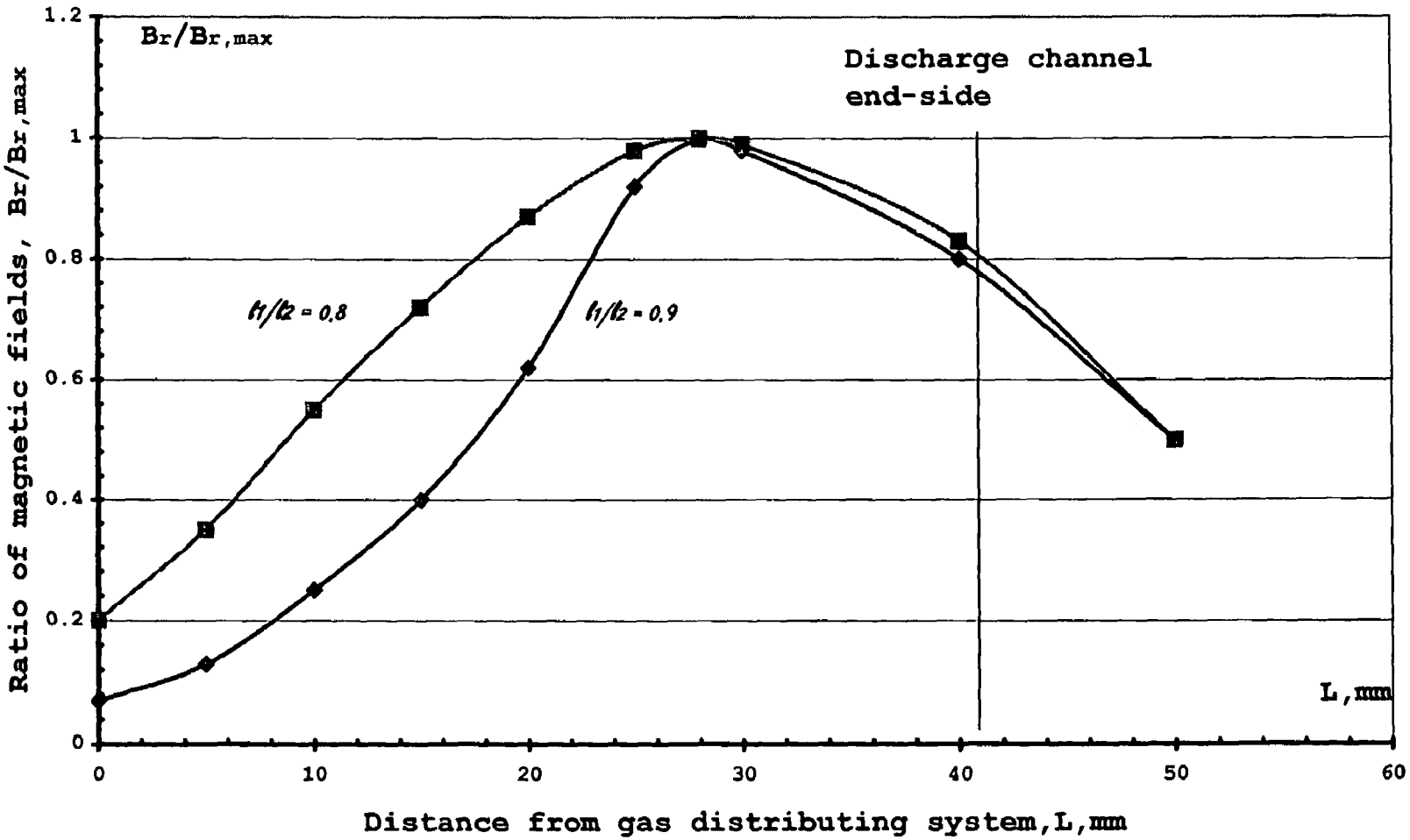
FIG. 6 shows a graphical representation depicting two particular magnetic field distributions in a discharge channel of the invented Hall-type ion source with a circular discharge region and with only an outside boundary with a positive magnetic gradient in a discharge channel with certain ratios of internal and external magnetic screens lengths, $l_1/l_2$=0.8 and 0.9.

In FIG. 6 presents a value of $B_r/B_{r,max}$ as a function of a distance from a gas distributing system. These magnetic field distributions are at different ratio of internal magnetic screen length $l_1$ and external magnetic screen $l_2$, $l_1/l_2=0.8$ and 0.9. Thus, by changing magnetic screens lengths and a distance between central and external poles and achieving necessary magnetic field gradient, $\partial B_r/\partial z$ it is possible to have maximum values of an ion beam current.

A distance, $l_5$ (FIG. 5) between magnetic poles shows that a configuration of magnetic field at $l_5$=max characterizes an end-Hall ion sources behavior, and at $l_3$=min characterizes a closed drift ion source behavior.

Figure 7:
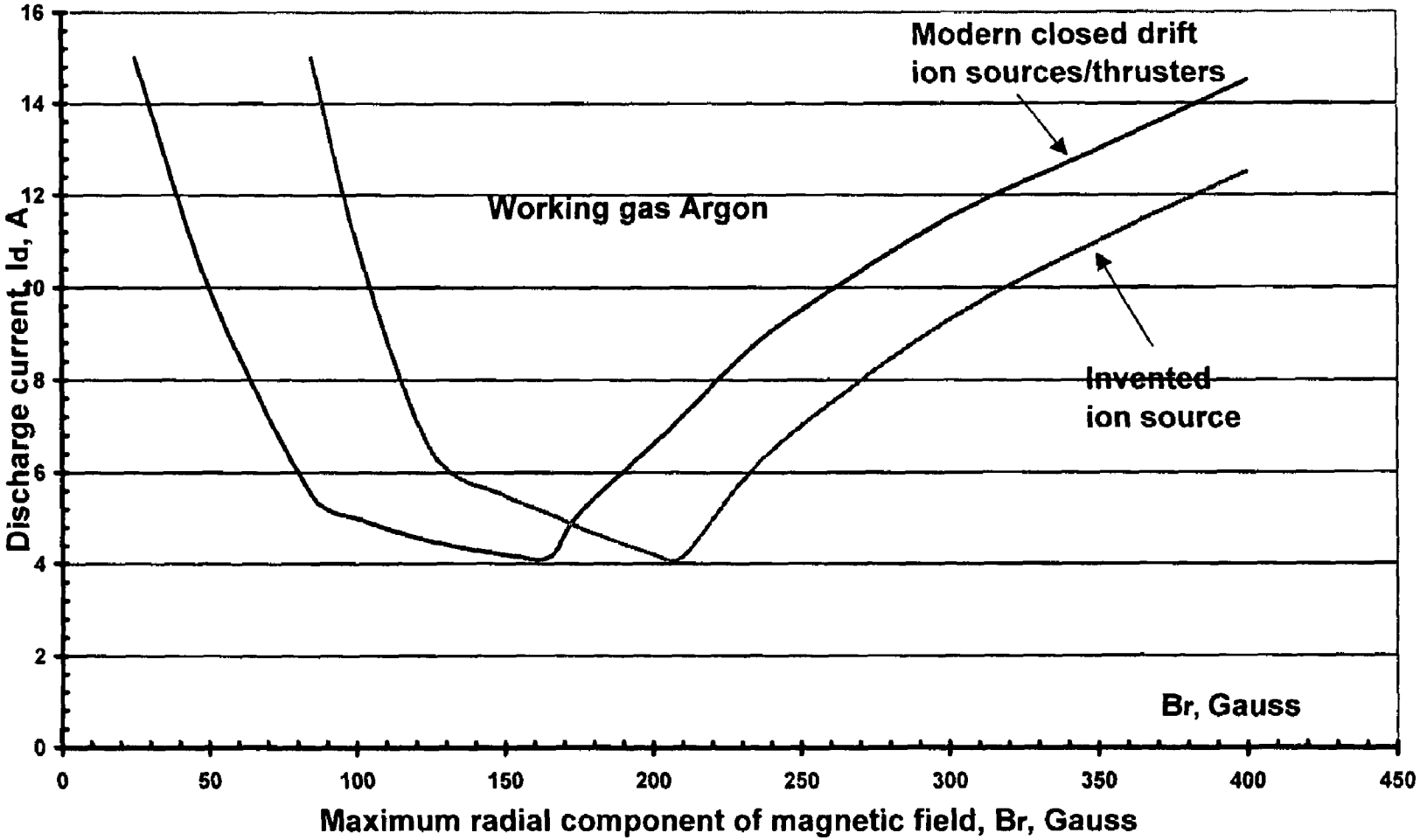
FIG. 7 shows a graphical representation of an ion source's discharge current, $I_d$ as a function of maximum radial magnetic component, $B_r$ in invented ion source and in typical closed drift ion sources.

FIG. 7 presents optimization curves for a discharge current, $I_d$ as a function of maximum radial component of magnetic field, $B_r$ for an invented ion source and modem closed drift ion sources. Regulation of operational parameters of ion source is possible to conduct through variation of several different values. At fixed discharge current, $I_d$ several values can be changed: a discharge voltage, $V_d$, an anode mass flow, $\dot{m}_a$, and a magnetic field values, $B_r$ and $B_z$. For obtaining high efficiency of transformation of working gas material into ion beam current it is impractical to change all discharge parameters: discharge voltage, $V_d$, working gas mass flow, $\dot{m}_a$ and magnetic field, $B_r$ and $B_z$. However, at fixed $V_d$ and $\dot{m}_a$ there is an optimum value of radial magnetic field, $B_r$ and axial magnetic field, $B_z$, at which an ion beam current, $I_b$ achieves its maximum values. In this case a discharge current, $I_d$ achieves its minimum value. This situation is illustrated in FIG. 7 that shows that an optimum discharge current in invented ion source is remained at the same discharge current with a radial magnetic component, $B_r$ shifted into a side of larger magnetic fields by about 100 G.

Internal and external magnetic screens, 41, 42 (FIG. 4) can be made of one U-shaped magnetic screen; its variation of lengths, $l_1$, $l_2$ and thickness, $d_2$ helps to select an optimum value of magnetic field in a discharge channel developed between discharge channel internal, 42 and external, 36, 37, 38 walls. Experiments show that an optimum operation for an ion source provides the following important parameters of an ion source:

A maximum ratio of an ion beam current, $I_b$ to a discharge current, $I_d$, or $I_b/I_d \approx 0.8$–0.9;

A maximum ratio of an ion beam mean energy, $E_b$ to an applied potential, which is a discharge voltage, $V_d$, or $E_b/V_d \approx 0.8$–0.9;

A minimum mass flow of working gas, $\dot{m}_a$.

The invented Hall-current ion source with a hybrid positioning of a central magnetic pole of a bout a half a distance between a gas distributing system and an external magnetic pole and with a high positive gradient of magnetic field helps to improve also electromagnetic focusing of plasma flow inside a discharge chamber from discharge chamber walls into a median part of a discharge chamber. In invented ion source maximum values of electric field are realized in a region of maximum values of magnetic field (FIG. 6) with $B_r \geqq 0.6\ B_{r,max}$, where a plasma "resistance" is at maximum value and takes place main acceleration of ions created near an anode area. Electromagnetic focusing of ion flow in invented ion source makes parasitic thermal effects (plasma touches discharge chamber walls0 negligible. It also reduces a length of ionization region and leads to a monochromatization of ion beam energy. A ratio, $I_b/I_d$ increases with a magnetic gradient value, $\partial H_r/\partial z$ to 0.8–0.9.

In conclusion, the invented Hall current ion source with high gradient of magnetic field has another definite advantage over end-Hall ion source. The so-called "flight" oscillations with a wide range of frequencies practically disappear. There are only large-scale low-frequency oscillations (about 10–25 kHz) providing transfer of electrons from an electron source (hot filament or hollow cathode) to anode, but not leading to motion of ions to discharge channel sides. A suppression of oscillations by high gradient of magnetic field and high values of mobility of electrons help to separate ionization and acceleration areas in the region of high magnetic gradient, to separate this region from anode to cathode, i.e. to realize a closure of electron current with minimum energy spent for transportation despite of significant distances between this region and cathode.

I claim:

1. A Hall current ion source with a positive magnetic gradient, with electric potential applied between cathode and anode, where electrons move in a discharge channel in mainly radial magnetic field with a minimum magnetic field in anode area and where electrons are magnetized and move in closed drift trajectories, and ions are not influenced by magnetic field and move along axis to an ion source's end-side; this ion source comprises of:

a gas distributing system placed under anode in a volume, which is a subject of electron penetration and photo-ionization radiation, in a lower part of discharge channel, where a discharge channel length is larger than a discharge channel width, with ionizing gas supplying holes directed tangentially into a gas input area, so a gas vortex flow is established providing uniformly distributed working gas under and into anode area;

an anode with positive electric potential; anode is located close to a gas distributing system, and it is placed in a discharge channel external wall between two cylindrical external dielectric walls;

a cathode-neutralizer placed outside ion source at a certain distance to provide optimal plasma flow with electrons that move into anode area to close electrical circuit, for ionization of working gas molecules, and for neutralization of ions in discharge channel and outside an ion source;

a magnetic field that mainly radial in area around gas distributing system, over anode and having a minimum value in anode area; a radial magnetic field is increasing its value along a central magnetic pole in a form of a protrusion till end of a protrusion, and from this protrusion to a discharge channel end-side having both components of magnetic field, radial and axial in area over a central magnetic pole to a discharge channel exit;

a magnetic circuit for establishing a magnetic field necessary for magnetizing electrons and preventing them from straight motion from a cathode neutralizer to anode;

magnetic poles placed at exit part of ion source and a magnetic pole in a center of a discharge channel in a form of protrusion with a magnet or electromagnet placed in a central magnetic pole;

magnetic screens surrounding central magnetic pole and discharge channel, a variation of length of internal and external magnetic screens provides necessary positive gradient of magnetic field in anode area and in most part of discharge channel for efficient ionization and suppression of oscillations of discharge current and voltage, magnetic screens with magnetic means provide a magnetic field that has a minimum value, close to zero, at an anode area, in such away that a magnetic field increases along a discharge channel and at a distance of about ½ of a discharge channel's length its maximum values of magnetic field become $B_r \geqq 0.6\ B_{r,max}$.

2. A Hall current ion source according to claim 1, where a conducting anode is placed between conducting parts of outer part of discharge channel; these conducting parts are separated from anode by dielectric inserts or by a gap, and these conducting parts of discharge channel are under a floating potential.

3. A Hall current ion sources according to claim 1 with placement of magnet or electromagnets in area between outside ion source's wall and an outside magnetic screen, and instead of magnet, a magnetically permeable material placed in a central protrusion and serves as a central magnetic pole.

* * * * *